United States Patent [19]

Bröning

[11] Patent Number: 4,491,263

[45] Date of Patent: Jan. 1, 1985

[54] HEEL ATTACHING MACHINE

[75] Inventor: Manfred Bröning, Frankfurt am Main, Fed. Rep. of Germany

[73] Assignee: USM Corporation, Farmington, Conn.

[21] Appl. No.: 478,261

[22] Filed: Mar. 24, 1983

[30] Foreign Application Priority Data

Apr. 14, 1982 [DE] Fed. Rep. of Germany ..... 3213676

[51] Int. Cl.[3] ..... A43D 67/00; A43D 79/00

[52] U.S. Cl. ..... 227/152; 12/42 R; 12/42 B; 227/154

[58] Field of Search ..... 12/42 R, 42 B, 43, 43.5, 12/42.5, 50, 50.1, 50.2, 50.3, 50.4; 227/152, 156, 110, 154, 7

[56] References Cited

U.S. PATENT DOCUMENTS 2,238,054 4/1941 Hart, Jr. ..... 12/42 B 3,087,161 4/1963 Ruelle ..... 227/7

*Primary Examiner*—Paul A. Bell

*Attorney, Agent, or Firm*—Donald N. Halgren

[57] ABSTRACT

A heel attaching machine is provided with an abutment mounted on a pneumatic piston and cylinder unit. After a shoe upper and heel have been positioned on the nailing stand of the machine, the abutment is moved upwards into engagement with the shank region of the insole of the shoe. The abutment then serves to prevent the upper from tipping about the edge of the nailing stand during insertion of the heel attaching nails.

1 Claim, 1 Drawing Figure

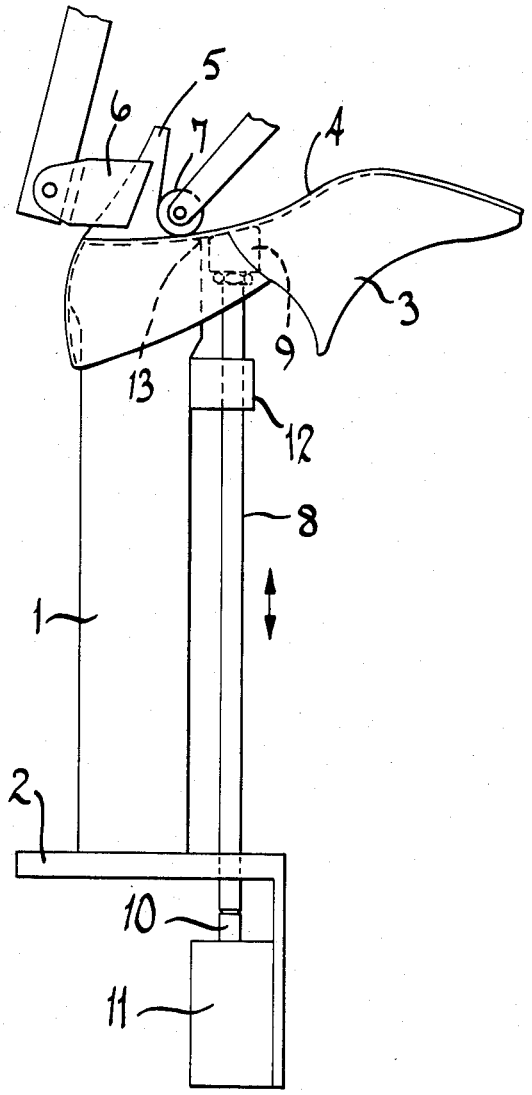
5
6
7
4
3
9
13
12
8
1
2
10
11

HEEL ATTACHING MACHINE

BACKGROUND OF THE INVENTION

1. Field of the Invention

The invention concerns itself with an apparatus for the nailing on of heels onto shoe uppers having insoles, in which the shoe upper is placed on a nailing stand and a holddown presses the heel onto the nailing stand.

2. Prior Art

A heel nailing apparatus is shown in FIG. 1 of DE-OS No. 22 57 088 in perspective view. In order to nail a heel on to a shoe upper, a heelless upper is placed on the nailing stand of this apparatus and thereupon the heel to be nailed on is positioned on the shoe upper. A holddown is arranged first of all in a rest position above the heel and is then moved out of this rest position downwards until it is against the heel and presses the latter onto the shoe upper, whereby the heel and upper are held firmly in a definite position by means of the holddown and the nailing stand. The nailing process then takes place through the nailing stand, by the drivers arranged in the nailing stand, the nails, which previously have been automatically positioned in front of the drivers, drive in the substantially vertical direction upwards through the insole into the heel, whereby the heel is fixed on the shoe upper. The holddown is then moved away from the heel through an upwards movement whereby the shoe upper with heel is freed and can be removed from the nailing stand by hand. It has now appeared that, through the driving in of the nails, the shoe upper can be lifted from the nailing stand. The invention takes as its basis the object to give the shoe upper such a support that this lifting is avoided.

BRIEF SUMMARY OF THE INVENTION

The present invention comprises a heel nailing machine that has a support is arranged next to the nailing stand on its side towards the shoe shank, which support ends in an abutment adapted to the form and position of the insole, wherein the support rests on the piston of a pneumatically operated piston-cylinder unit which is operated, after pressing of the shoe upper on the nailing sand, with such pressure that the insole stops the abutment, wherein the piston-cylinder unit has such inertia that blows resulting from the nailing process acting on the abutment are absorbed by the latter.

Surprisingly, the lifting of the shoe upper from the nailing stand is not prevented by a construction element pressing on the shoe upper in the direction of action of the holddown, that is from above, but by the support ending in the abutment, which presses directly upwards against the insole of the shoe upper. It shows therefore that the lifting of the shoe upper from the last stand represents substantially a tipping movement in which the shoe upper is tipped about the edge of the lasting stand facing away from the heel of the shoe upper, the shoe upper therefore makes a turning movement which is prevented by the abutment. Moreover, no special mechanism is required for the limiting of the end position of the abutment, as the abutment is stopped in its upwards movement, actuated by the pneumatically activated piston-cylinder unit, by the insole. For the accommodation of the tendency of the shoe upper to carry out the mentioned movement, the inertia of the piston-cylinder unit is enough, in that the short blows in the driving in of the nails are absorbed without difficulty.

BRIEF DESCRIPTION OF THE DRAWINGS

The objects and advantages of the present invention become more apparent when viewed in conjunction with the drawing in which: FIG. 1 is a side elevational view of the apparatus.

DESCRIPTION OF THE PREFERRED EMBODIMENT

The apparatus shown in the FIGURE exhibits fragmentarily only those parts which are of importance for the understanding of the invention. It moreover takes by reference the above mentioned state of the art which exhibits the already known construction elements of such an apparatus. A nailing stand 1 is fixed with its lower end on a machine frame 2. On its upper end a shoe upper 3 is arranged so that its insole 4 is on the upper end of the nailing stand 1. In the nailing stand 1 is installed, in a known manner, not shown channels and drivers for nails with which a heel 5 may be attached to the insole 4 in a known manner. The heel 5 is held in a definite position by a pressing piece 6 and a clamping element 7 which forms the holddown. Before the positioning of the heel 5 on the insole 4, the pressing piece 6 and the clamping element 7 are in a rest position above the heel 5, which position is not represented in the FIGURE. After the positioning of the heel 5, the pressing piece 6 and the clamping element 7 are moved into the position represented in which they, as aforesaid to hold the heel 5.

To the side next to the nailing stand 1 and indeed on its side towards the shoe shank, the support 8 is arranged which ends in the abutment 9 adapted to the shape and represented position of the insole. The support 8 rests on a piston 10 of a piston-cylinder unit 11 arranged in the frame 2, and is pushed by the travel of the piston 10 upwards against the insole. In its upper region, the support 8 is slidingly held by a guiding part 12.

Before positioning of the shoe upper 3, the abutment 9 is in a lower position, not shown, out of which it then is brought into the position shown in the FIGURE, in which it supports the insole 4, as explained above, by travel of piston 10, wherein the upwards travel of the abutment 9 is stopped by reaching the insole. The force proceeding from the piston-cylinder unit 11 is not quite sufficient to raise the insole 4 from the upper end of the nailings and 1 or to bend the insole 4 upwardly. Such a dimensioning of the force of the piston-cylinder unit allows itself to be achieved without further ado in that the piston-cylinder unit 11 supplied with an appropriate pneumatic pressure.

If now nails are driven in known manner from below through the nailing stand 1, wherein these nails force their way through the insole 4 and into the heel 5, then a tipping moment acts on the insole 4 in the region of its position on the nailing stand 1, which moment gives the insole 4 the tendency to tip about the if necessary rounded off edge 13 of the upper end of the nailing stand 11. This is now with certainty prevented by the abutment 9 supported on the piston-cylinder unit 11 and indeed by the inertia of the arrangement formed from the abutment 9, support 8 and piston-cylinder unit 11. This inertia suffices to absorb the short blows on the heel 5 in the knocking on of the nails.

The heel 5 is thereby fixed safely onto the insole 4, as the insole 4 and heel 5 are held in definite position in the knocking in of the nails.

I claim:

1. Apparatus for the nailing on of heels onto shoe uppers having insoles, in which the shoe upper is placed on a nailing stand and a holddown presses the heel onto the nailing stand, wherein a support 8 is arranged adjacent to the nailing stand 1 on its side towards the shoe shank, which support has an abutment on its upper end adapted to the form and position of the insole 4, wherein the support 8 rests on a piston 10 of a pneumatically operated piston-cylinder unit 11 which is operated, after pressing of the shoe upper 3 on the nailing stand 1, with such pressure that the insole 4 stops the abutment 9, wherein the piston-cylinder unit 11 has such inertia that blows resulting from the nailing process acting on the abutment 9 are absorbed by the latter.

* * * * *